United States Patent [19]

Speer

[11] 4,250,862

[45] Feb. 17, 1981

[54] BALL PROJECTING DEVICE CAPABLE OF PROVIDING SPIN

[76] Inventor: Richard Speer, Oak Hall, Ware Neck, Va. 23178

[21] Appl. No.: 929,675

[22] Filed: Jul. 31, 1978

Related U.S. Application Data

[63] Continuation-in-part of Ser. No. 894,162, Apr. 5, 1978, Pat. No. 4,212,284, which is a continuation-in-part of Ser. No. 764,197, Jan. 31, 1977, Pat. No. 4,094,294.

[51] Int. Cl.[2] ..... F41F 1/04

[52] U.S. Cl. ..... 124/56; 124/83

[58] Field of Search ..... 124/56, 80, 81, 83

[56] References Cited

U.S. PATENT DOCUMENTS

| | | | |
|---|---|---|---|
| 3,847,132 | 11/1974 | Schatz | 124/81 X |
| 4,002,336 | 1/1977 | Beaver et al. | 124/56 X |
| 4,027,646 | 6/1977 | Sweeton | 124/56 |
| 4,054,120 | 10/1977 | Foley | 124/83 X |
| 4,073,280 | 2/1978 | Koehn et al. | 124/83 X |
| 4,094,294 | 6/1978 | Speer | 124/56 |

*Primary Examiner*—Richard T. Stouffer
*Attorney, Agent, or Firm*—Barry G. Magidoff

[57] ABSTRACT

A ball projecting device, preferably pneumatically operated, is provided wherein the projected ball has "spin". The device comprises a projection tube including a curved portion, wherein the area of maximum curve radius of the curved portion, preferably is provided with a material having a high coefficient of friction; the ball is caused to roll along this high friction area, thereby imparting spin. The tube is preferably pivotable, such that the elevation of the tube end can be adjusted.

15 Claims, 4 Drawing Figures

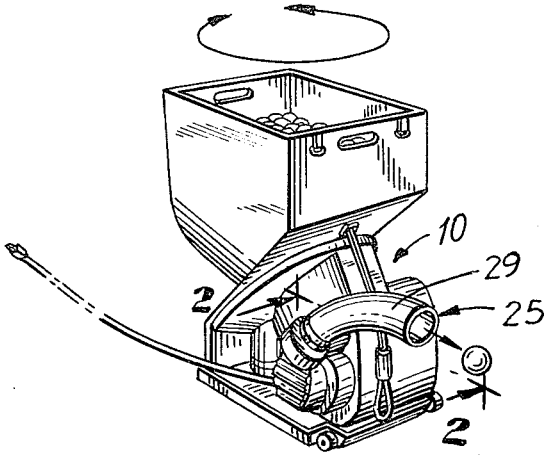
FIG. 1
FIG. 2
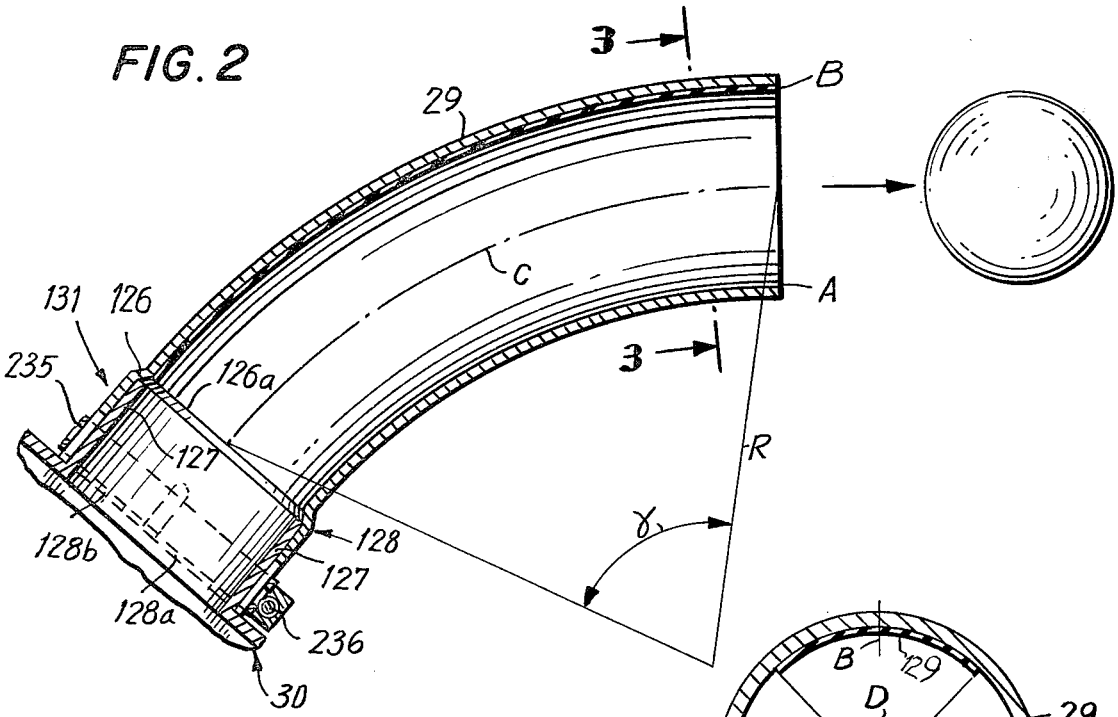
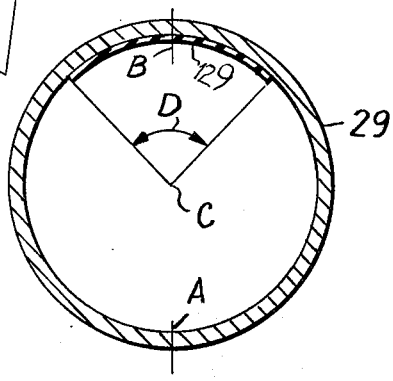
FIG. 3

BALL PROJECTING DEVICE CAPABLE OF PROVIDING SPIN

This is a continuation-in-part of copending application Ser. No. 894,162, filed on Apr. 5, 1978, and now U.S. Pat. No. 4,212,284, which is in turn a continuation-in-part of application Ser. No. 764,197, filed on Jan. 31, 1977, and now U.S. Pat. No. 4,094,294.

This invention is directed to a device for the projecting or "throwing" of articles, and in particular to an improved, preferably pneumatically operated projecting device for the throwing of balls, such as tennis balls, baseballs and the like, which applies a spin to the projected ball.

The prior art is well acquainted with a variety of pneumatically operated devices for the serving of, especially, tennis balls, e.g., intended to provide the tennis player with the opportunity to practice ball return, especially after a serve. Although they are of varying effectiveness in mechanically providing a facsimile of the serve that a living partner would provide, they are generally unable to provide practice in returning that most difficult of shots, the ball with "spin".

It is an object of the present invention to provide an improved ball serving device which is capable of serving up a ball having applied "spin".

In accordance with the present invention, there is provided a device for projecting a ball from a barrel, wherein the projected ball has a rotational velocity, i.e., "spin", applied thereto. The ball can be rotated about several transversely aligned axes to provide what are commonly referred to as "top spin", "back spin", or "side spin", or even combinations thereof, as can be provided by a player with a tennis racket.

The ball projection device of this invention comprises a ball projection barrel having a curved tube portion. Preferably, a longitudinal strip of the internal surface of the curved tube portion intersecting the maximum curve radii of the tube is formed of a material having a relatively high coefficient of friction. The internal diameter of the curved tube is slightly larger than the ball passing therethrough such that there is a narrow air gap between the ball and the internal surface intersecting the minimum curve radii of the tube. The ball passing through the curved portion is pressed against the line of maximum curve radii by the action of so-called "centrifugal force"; the ball is caused to roll along the high friction surface, thus imparting a rotational velocity, or spin, to the ball when it passes out of the barrel. The curved portion is thus preferably the outermost portion of the barrel.

The energy for projecting the ball is preferably provided by pneumatic force as in the two parent cases, U.S. Pat. No. 4,094,294 and U.S. Application Ser. No. 894,162. The curved portion of the barrel is preferably capable of being adjusted to different angles of elevation, i.e., relative to the horizontal. This can be provided, e.g., by a pivotal connection between the barrel and the rest of the mechanism.

A further understanding of the invention can be achieved from, and the preferred embodiments for achieving the desired objects are set forth in, the embodiments illustrated in the accompanying drawings. The illustrated embodiments, however, are intended merely to be exemplary of the presently known preferred means for carrying out the invention, and are not intended to be exclusive of the full scope of the invention, which is defined by the appended claims.

Referring to the drawings

FIG. 1 is a perspective view of the complete apparatus in operation;

FIG. 2 is an enlarged side elevation view along line 2—2 of FIG. 1;

FIG. 3 is a sectional view taken on line 3—3 of FIG. 2;

Figure 4:
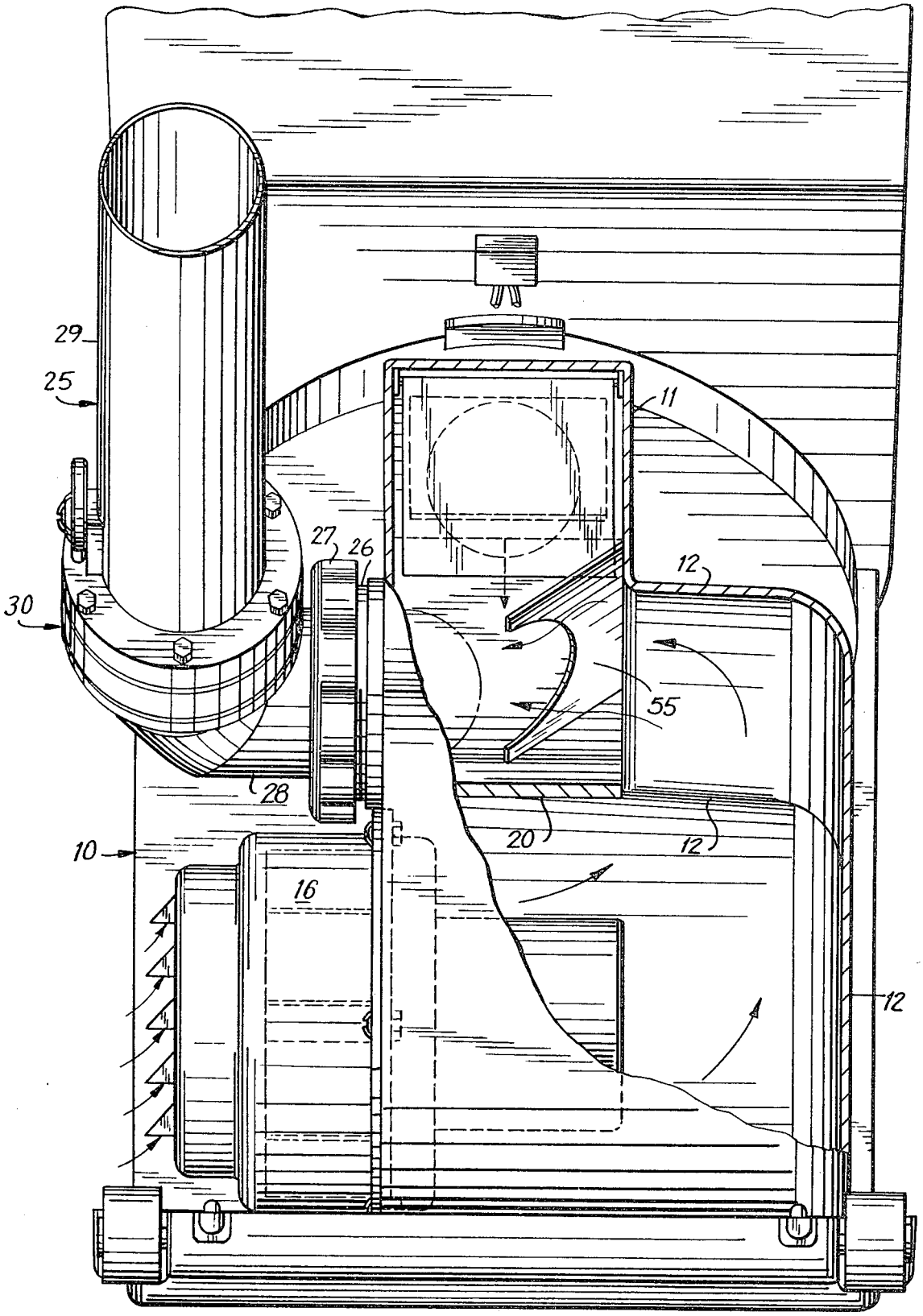
FIG. 4 is a partially broken away front elevation view of the complete device.

Referring to the drawing, FIGS. 1 and 4 depict the overall construction of a preferred tennis ball serving machine in accordance with the present invention. Such a machine comprises, generally, a body portion, generally indicated by the numeral 10, including an air chamber lower portion 12, which in turn is in fluid flow connection with the output end of a blower 14, and an upper ball chute portion 11.

The angled barrel, generally indicated by the numeral 25, is rotatably connected to the body 10 and secured by a knurled nut 27 to a complementarily threaded barrel stub 26.

The barrel stub 26 is formed in the upper portion of the air chamber 12, substantially at the interface with the ball chute portion 11. The inner elbow portion 28 is connected to the outer curved barrel portion 29 of the barrel 25 by a flange member, generally indicated by the numeral 30.

The outer curved barrel 29, is connected to the flange 30, preferably by a locking taper joint or a threaded joint generally indicated by the numeral 131. A flange barrel stub 127 is secured to, or preferably formed integral with, the outer portion of the flange 30, and has at the end thereof a male tapered portion **126*a*. The curved barrel portion 29 has an expanded inner end 128 defining an internal matching female tapered portion 126 capable of being secured to the male portion 126*a* of barrel 127. To prevent rotation of the curved portion 29 relative to the stub 127, a conventional hose clamp 235 is applied around the expanded inner end 128. Segmented portions 128*a, b, c,* are formed along the edge of the expanded inner end 128**.

The hose clamp 235, as shown is tightened by thumb screw 236 via a conventional worm gear mechanism. The clamp forces the segmented portions **128*a, b, c,* etc., together and tightly against the outer surface of the barrel stub 127. This sufficiently firm friction connection secures the barrel at any elevation position desired. The elevation is readily changed by merely loosening the thumb screw 236 and pivoting the curved barrel portion 29** up or down, with infinite selectivity being possible.

It is clear that in addition to tapered connections as shown, threaded joints or other means for connecting additional barrel lengths are well-known in the art and can be equally well used. It is preferred that the interior diameter of the barrel remain substantially constant along its length, such that the barrel pieces be connected in a manner so as to maintain a substantially constant internal diameter of the barrel, or at least an inner barrel surface with no discontinuities, or sharp changes in internal diameter.

Internal diameter of the barrel is to be determined by the range of ball sizes within the nominally standardized range. For example, tennis balls vary depending upon manufacturing tolerances, age and degree of use, or wear. The barrel in a tennis ball service device, in accordance with this invention, should be sized to provide operating clearance for the largest new tennis ball.

The remaining portions of the mechanism and construction of the interior of the body 10 of the ball projecting device of this invention is substantially as described in copending application Ser. No. 894,162 filed Apr. 5, 1978 and/or in U.S. Pat. No. 4,094,294. Those portions of the above-identified copending application and patent which describe the interior of the body portion and its operation are incorporated herein by reference, as if fully set forth herein.

Preferably, means are provided for controlling the velocity of a ball projected from the barrel 25. Most preferred such means are shown in copending application Ser. No. 894,162. Other preferred means are shown in U.S. Pat. No. 4,094,294. Other means known to the prior art or to be developed in the future can be used to control velocity. Similarly, any pneumatic projection apparatus, or other type of projection apparatus, can be used as desired, especially where a projection force is continuously applied as the ball moves along the curved tube.

The curved barrel 29, is preferably formed as the arcs of circles, i.e., the circumferential line of minimum curve radius of the interior surface of the tube, indicated as A in FIG. 2, and the circumferential line of maximum curve radius, indicated as B in FIG. 2, are preferably arcs of substantially concentric circles. The difference between the radii of arcs A and B, is determined by the size of the balls to be projected, i.e., the distance between A and B. The length of the curved tube, i.e., of the midline arc between A and B, and the radius of the midline determine the degree of spin, i.e., rotational velocity imparted to a ball. Generally, for a given ball size, the larger the radius R, of the midline arc C and the shorter the length L, of the midline arc C, the slower the rotational velocity of the ball leaving the barrel. The spin should preferably not be greater than that to be encountered in a tennis game. This, of course, depends upon the expertise of the user's anticipated opponents. The length of the tube 29 is most directly determined in terms of the degrees of arc the midline C subtends, i.e., $\gamma$, in FIG. 2. Generally, the curve radius R of the midline C is preferably in the range of from about 6 to about 14 times the radius of a ball to be projected; the ball diameter is preferably only slightly smaller than the internal diameter of the curved barrel 29, i.e., between line A and line B. The length of the midline C is preferably in the range of from about 30° to about 90° of arc.

This device is capable of handling a range of ball sizes, generally differing by as much as 10% in outside diameter. The largest ball to be used, however, should be slightly smaller than the internal cross-sectional diameter of the tube 29, such that the ball rolls along the line of maximum curve radius B, but does not touch the line of minimum curve radius, A.

To insure that the ball does not merely slide along the maximum curve line B, the interior surface of the tube 29 is preferably coated along that line with a material 129 having a high coefficient of friction. The high friction material 129 is preferably applied along the full length of curved tube 29 over a portion of the internal surface measured, in angular terms of preferably at least about 10° on either side of the line B of maximum curve radius, and generally not more than about 90° on either side of the line B. In the drawings, the angle D is optimally about 90°.

Suitable such high friction materials for the coating 129 include the natural and synthetic rubbers, and especially neoprene. Other suitable materials can be used, if desired.

The remaining internal surface of the curved tube 29 is preferably formed of a relatively low friction material. Specifically, the curved tube 29 can be vacuum or pressure formed from, e.g., aluminum, and the inner surface formed as a relatively smooth, polished surface. Again, other suitable materials can be used, for example, other synthetic resins or metals.

The embodiments of the present invention which are claimed are as follows:

1. A device for projecting a ball, the device comprising a ball directing tube having an internal circumference for confining and directing a ball to be projected, said tube including a breech and a muzzle, at least the outermost portion of the tube extending out to the muzzle being curved along the longitudinal extent thereof, said tube defining a midline along said longitudinal extent which is curved along a substantial portion of the tube's length, said midline being generally coextensive along said portion with the arc of a circle; gas pressure supply means in fluid flow connection with the tube to provide gas under pressure thereto; a first end of the tube being pivotally connected to the pressure supply means, pivotable about an axis transverse to the longitudinal midline of the tube; means for feeding a ball into the tube at the breech end thereof for movement along the tube in a direction from the first end of the tube toward the muzzle end of the tube; the ball feeding means being capable of feeding a ball slightly smaller than the internal diameter of the curved portion of the tube; whereby a ball projected from the tube has a rotational velocity imparted thereto.

2. The device of claim 1, comprising a longitudinal strip of high friction material along the line of maximum radius of curvature on the internal surface of the curved portion of the tube.

3. The device of claim 2 wherein the friction material is present on the internal surface of the curved tube over an area defined by an angle of from about 20° to about 180°, extending along both sides of the line of maximum curve radius along the internal circumference of the tube.

4. The device of claim 1 wherein the high friction material comprises a synthetic or natural rubber.

5. The pneumatic device of claim 4 wherein the friction material is neoprene.

6. The device of claim 1, comprising in addition means for securing the pivotable tube relative to the gas pressure supply means, whereby the angle at which the ball is projected can be determined.

7. The device of claim 1, comprising in addition detent means intermediate a curved portion of the tube and the gas pressure supply means, for transiently restraining the movement of a ball therethrough.

8. The device of claim 7 wherein the detent means comprises an inflatable member within the ball-directing tube having means operatively connected to the pressure supply means for inflating the inflatable member and means to deflate the member, whereby a ball in the tube is restrained when the detent member is inflated and is permitted to pass through the tube when the detent member is in the deflated condition.

9. The device of claim 7 wherein the gas pressure supply means is an air compressing means having inlet means in fluid flow connection to the atmosphere and outlet means in fluid flow connection to the first end of the tube.

10. The device of claim 1 wherein the radius of the midline of the curved tube is at least about six times the internal radius of the tube.

11. The device of claim 10 wherein the curved portion of the tube comprises substantially the arc of a circle.

12. The device of claim 11 wherein the radius of the midline of the tube is in the range from about 6 to about 14 times the internal radius of the tube.

13. The device of claim 1 wherein the curved tube subtends at least about 30° of arc.

14. The device of claim 13 wherein the curved tube subtends from about 30° to about 90° of arc.

15. The device of claim 1 comprising in addition a reservoir containing a plurality of balls, each ball having a diameter slightly smaller than that of the curved portion of the tube.

* * * * *